United States Patent [19]

Okuno

[11] 4,331,355

[45] May 25, 1982

[54] TEMPORARY LOCKING DEVICE

[75] Inventor: Toyoji Okuno, Tokyo, Japan

[73] Assignee: Sugatsune Industrial Co., Ltd., Tokyo, Japan

[21] Appl. No.: 183,285

[22] Filed: Sep. 2, 1980

[30] Foreign Application Priority Data

Oct. 8, 1979 [JP] Japan ..... 54-138074[U]

[51] Int. Cl.[3] ..... E05C 17/56

[52] U.S. Cl. ..... 292/251.5; 292/DIG. 4

[58] Field of Search ..... 292/DIG. 4, 251.5

[56] References Cited

U.S. PATENT DOCUMENTS

| | | | |
|---|---|---|---|
| 2,586,356 | 2/1952 | Lewis | 292/DIG. 4 |
| 3,785,004 | 1/1974 | Stoffregen | 292/DIG. 4 |
| 4,227,726 | 10/1980 | Sorimachi | 292/251.5 |
| 4,270,781 | 6/1981 | Nishimura . | |

*Primary Examiner*—Richard E. Moore

*Attorney, Agent, or Firm*—George B. Oujevolk

[57] ABSTRACT

A push type temporary locking device with a catcher of a magnet used for locking a closed door of a cabinet for an electronic equipment or furniture or the like. This temporary locking device comprises a supporting box fixedly secured to a door mounting frame, a drive element attached with a catcher such as a magnet at its front end and slidably engaged within the supporting box, a driven element having at least two recesses symmetrically provided thereat and rotatably supported at the drive element, a rotating projection eccentrically contacting the driven element at the depressing end of the drive element into the supporting box, and a rotating and engaging extension eccentrically contacting the driven element to thereby retain the driven element when the drive element is slightly moved forwardly and to rotate itself into the guide groove. Thus, this locking device can be readily attached to the door mounting frame and can also be smoothly and exactly open or close the door attached to the door mounting frame merely by disposing the door at its closed position.

4 Claims, 9 Drawing Figures

TEMPORARY LOCKING DEVICE

BACKGROUND OF THE INVENTION

This invention relates to a push type temporary locking device and, more particularly, to a push type catcher-contained temporary locking device with a magnet used for locking a closed door of a cabinet for an electronic equipment or furniture or the like.

The conventional temporary locking device of this type mostly opens a door by a pushing operation. All such locking devices incorporate separately a catcher made of a magnet or the like and a door opening spring mechanism and accordingly have common disadvantages of complicated attachment and disposition thereof to mounting frames.

SUMMARY OF THE INVENTION

Accordingly, an object of this invention is to provide a push type temporary locking device which can be readily attached to a mounting frame.

It is another object of this invention to provide a push type temporary locking device which can smoothly and exactly open or close a door attached therewith.

It is yet another object of this invention to provide a push type temporary locking device which can be readily and exactly assembled in its production.

It is a further object of this invention to provide a push type temporary locking device which can accurately engage its actuator with its guide groove in predetermined direction.

It is still another object of this invention to provide a push type temporary locking device which can readily engage a rotating projection with any of the recesses of its actuator.

It is still another object of the invention to provide a push type temporary locking device which is adapted for mass production inexpensively.

According to this invention, there is provided a push type catcher-contained temporary locking device which comprises a supporting box fixedly secured to a door mounting frame, a drive element attached with a catcher such as a magnet or the like at its front end slidably engaged within the supporting box, a driven element having at least two recesses symmetrically provided thereat and rotatably supported at the drive element, a spring operated as a door opening elastic mechanism, and a mechanism for locking or unlocking the drive element. Thus, this locking device can be readily attached to a door mounting frame and can also smoothly and exactly open or close a door attached therewith.

BRIEF DESCRIPTION OF THE DRAWINGS

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
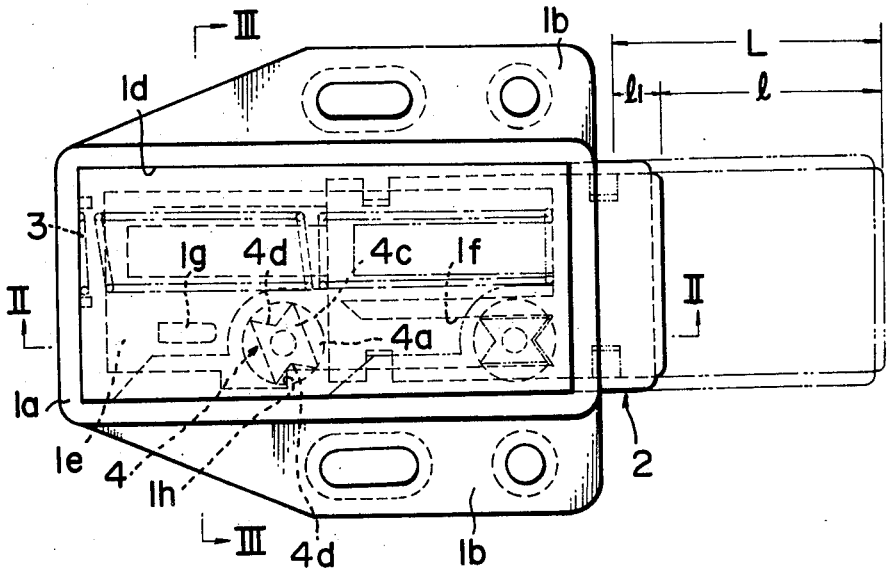
FIG. 1 is a back view of a preferred embodiment of the push type temporary locking device constructed according to this invention.

Reference is made to the drawings, particularly to FIGS. 1 through FIGS. 4(A)–4(C) showing one preferred embodiment of the push type catcher-contained temporary locking device constructed according to this invention, wherein like reference numerals designate the same parts in these drawings and the following views.

The push type temporary locking device a comprises a supporting case 1, a drive element 2, a spring 3, and a driven element 4 essentially.

Figure 2:
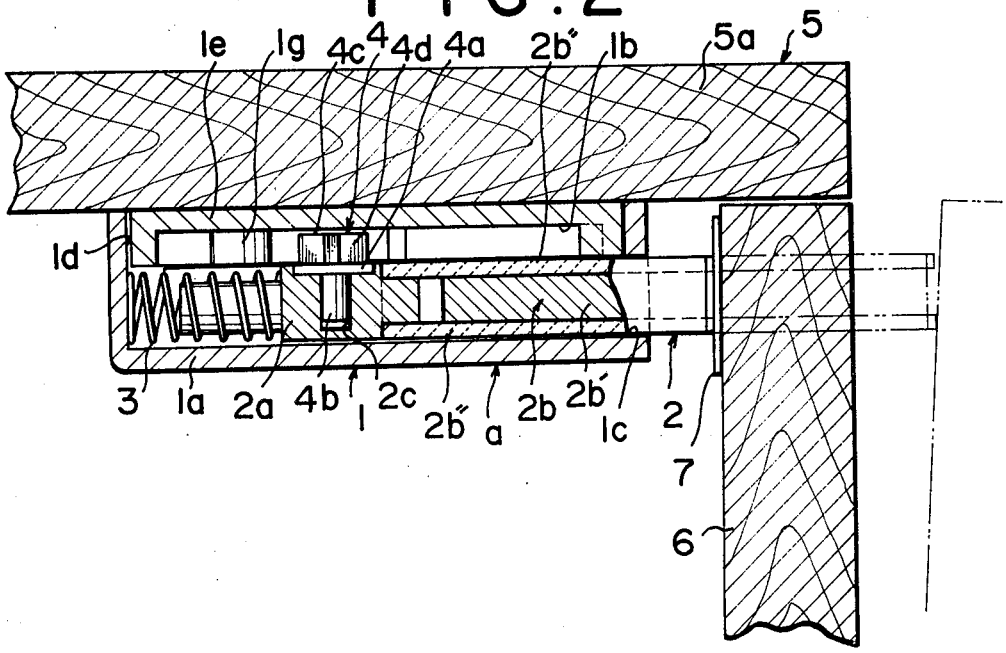
FIG. 2 is a longitudinal elevational sectional view of the locking device taken along the line II—II in FIG. 1.
Figure 3:
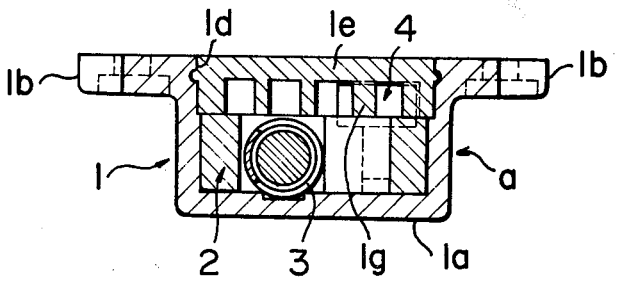
FIG. 3 is a lateral sectional view of the locking device taken along the line III—III in FIG. 1.
Figure 4A:
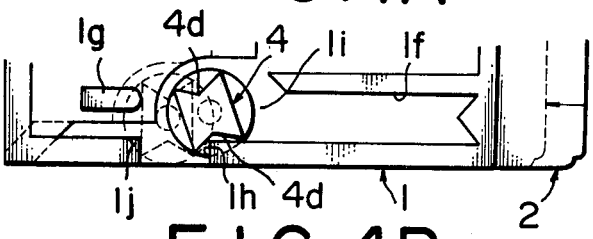
FIG. 4(A) through 4(C) are schematic views of the locking device showing the operation of the device in various stages.
Figure 4B:
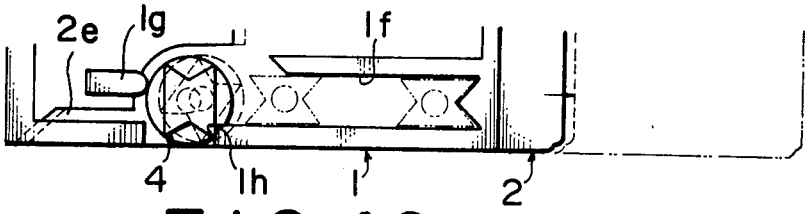
Figure 4C:
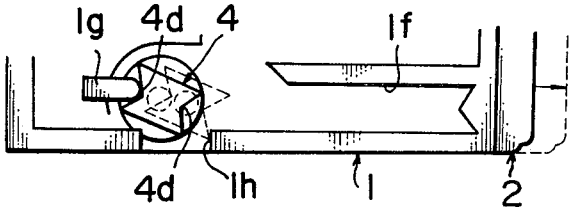

The supporting box 1 is formed in flat and laterally long rectangular box shape. This box 1 has brackets **1*b*, 1*b* laterally symmetrically projected from the right and left sides of its hollow box portion 1*a*. The brackets 1*b*, 1*b* of the box 1 are fixedly secured by screws to the inner surfaces of the top wall 5*a* of a door mounting frame 5 as shown in FIG. 2. The box portion 1*a* has an opening 1*c* perforated at its front wall for slidably telescoping the drive element 2 and another opening 1*d* perforated at its back side and closed by a back cover 1*e*. Further, the box 1 also has a guide groove if for engaging and guiding the driven element 4, a rotating projection 1*g* disposed at one end therein, and a rotating and engaging extension 1*h* for operating the driven element 4 upon movement of the drive element 2 as will be described in greater detail, within the inner wall of the box portion 1*a***.

The drive element 2 is formed in laterally rectangular cross section corresponding in shape to the opening **1*c*, and has a body 2*a* made of any material, and a catcher 2*b* such as a magnet attached to the front end portion of the body 2*a*. The catcher 2*b* has, in the exemplified example, a magnet body 2*b'*, and upper and lower iron pieces 2*b''*. There is disposed the compression coil spring 3 between the rear end of the body 2*a* of the drive element 2 and the inner surface of the rear wall of the box portion 1*a* in the box 1 as supported at the respective ends of the spring 3. Thus, the drive element 2 is so supported slidably in the hollow box portion 1*a* that the front end thereof is projected from the opening 1*c*. More particularly, the drive element 2 is elastically projected by the tension of the spring 3 from the box 1 as supported without being removed out of the box 1**.

The driven element 4 is rotatably supported at one side internal end of the drive element 2. The driven element 4 has a disk **4*a* integrally projected with a short shaft 4*b* therefrom on the central portion of its back surface, and also with a plurality of extensions 4*c* therefrom on the front surface in predetermined height and together with at least two V-shaped recesses 4*d*, 4*d* symmetrically formed at the peripheral edges of the extensions 4*c*. The driven element 4 is so rotatably supported at the drive element 2 that the short shaft 4*b* is rotatably inserted into the axial hole 2*c* perforated at the drive element 2 as surrounded by the guide groove 1*f*** of the box 1, the rotating projection 1g and the rotating and engaging extension 1h to thus form the temporary locking device a.

Figure 5:
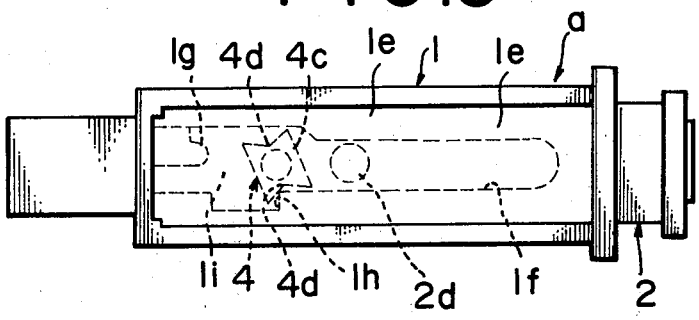
FIG. 5 is a back view of another preferred embodiment of the temporary locking device constructed according to this invention.
Figure 6:
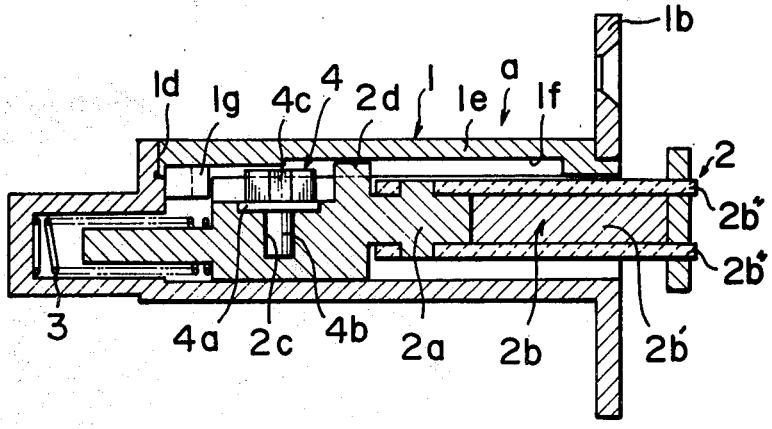
FIG. 6 is a longitudinal elevational sectional view of the temporary locking device shown in FIG. 5.

In FIGS. 5 and 6 showing another preferred embodiment of the push type temporary locking device of this invention, the supporting box 1 is formed in cylindrical shape, and has a bracket 1b formed at the front end thereof. This bracket 1b is mounted to the door mounting frame 5. The cylindrical hollow box portion 1a is buried in the mounting frame 5 to thereby mount the locking device at the frame 5.

The drive element 2 has an extension 2d integrally projected therefrom for preventing itself from rotating. This extension 2d is slidably inserted into the guide groove 1f of the box 1. The other components of this embodiment are the same as the first embodiment of the locking device.

In the above embodiment, the guide groove 1f may also be formed by cutting the inner surface of the back cover 1e of the hollow box portion 1a to thereby continuously form a recess 1i at the internal end thereof. Thus, the rotating projection 1g and the rotating and engaging extension 1h are thus formed by retaining the integral extensions partially cut when forming the recess 1i.

When thus formed, the guide groove 1f and the driven element 4 are visually engaged in assembling these projection and extension with the groove, and are readily and exactly assembled accordingly.

The driven element 4 has two V-shaped recesses 4d, 4d symmetrically formed thereat in flat drum-like shape as shown in FIGS. 1 through 6.

When the driven element 4 is thus formed, the element 4 may be accurately engaged with the guide groove 1f or disengaged from the groove 1f in predetermined set direction, and may also be accurately rotated as will be described in greater detail.

Figure 7:
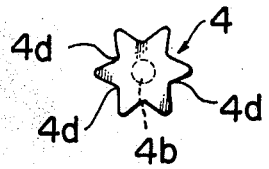
FIG. 7 is a plan view of modified example of a driven element used in the temporary locking device.

As shown in FIG. 7 showing modified example of the driven element 4, the driven element 4 has a plurality of or more than two of V-shaped recesses 4d, 4d, . . . formed thereat in a flat gear wheel shape. When the driven element 4 is thus formed, the element 4 may be rotated or engaged with the rotating projection 1g and with the rotating and engaging extension 1h at any of the recesses 4d, 4d, . . .

When using the locking device a thus constructed, the locking device a is arbitrarily mounted at the door mounting frame 5 for mounting a door 6. Then, it is noted that an attracting iron plate 7 is, in case that the catcher 2b is a magnet, mounted at the inside surface of the door 6 at the position corresponding to the end of the drive element 2, as shown in FIG. 2.

When the door is closed with the locking device a mounted at the door, the drive element 2 projected as designated by two-dotted broken lines in FIGS. 1 and 2 is urged by the door 6. Thus, the drive element 2 is depressed into the supporting box 1 against the tension of the coil spring 3 in the box 1.

At this time the driven element 4 engaged within the guide groove 1f is retarded together with the drive element 2 while being retained in predetermined direction due to the width of the guide groove 1f.

When the drive element 2 is thus depressed to its maximum stroke L into the box 1, the driven element 4 is eccentrically contacted with the rotating projection 1g. Accordingly, the driven element 4 is thus engaged at its recess 4d of V shape with the rotating projection 1g. Then, the driven element 4 is slightly rotated clockwise as designated by a solid line in FIG. 4(C) and thus retained obliquely with respect to the sliding direction of the drive element 2.

When the door is then opened, the drive element 2 is moved forwardly by the tension of the spring 3 in the box 1. When the drive element 2 is slightly moved forwardly at the stroke $l_1$, the rotating and engaging extension 1h is contacted with the driven element 4. Since the recess 4d of the driven element 4 is formed in V shape, the recess 4d is engaged with the corner of the rotating and engaging extension 1h. Thus, the driven element 4 is engaged and retained by the rotating and engaging extension 1h as designated by solid lines in FIG. 4(A). Accordingly, in FIG. 1, the drive element 2 is locked and retained at the position where the element 2 is depressed into the box 1 at its stroke $l=L-l_1$ to thereby obtain the locked state of the locking device a, where L is the maximum stroke.

When the door 6 is slightly pushed from the above locked state of the locking device, the drive element 2 is depressed at its stroke $l_1$ and the driven element 4 is accordingly eccentrically contacted with the rotating projection 1g. Consequently, the driven element 4 thus obliquely retained as described above is rotated and retained perpendicularly with respect to the sliding direction of the drive element 2 as designated by two-dotted broken lines in FIG. 4(A).

In the exemplified embodiments, a position control projection 1j is provided in parallel with the rotating projection 1g and a leg 2e for controlling the depressing stroke of the drive element 2 is inwardly fed from the drive element 2 to make contact with the inner surface of the rear wall of the box 1 so that the driven element 4 is retained, as described above, perpendicularly with respect to the sliding direction of the drive element 2. It is also noted that any of the position control projection 1j and the leg 2e may also be merely provided therefore within the spirits of this invention.

When the pushing operation of the door 6 backwardly is released with the locking device thus operated, the drive element 2 is pushed forwardly by the tension of the spring 3. Accordingly, the driven element 4 is contacted at its one end with the rotating and engaging extension 1h as designated by the solid lines in FIG. 4(B) at the position where the drive element 2 is slightly moved forwardly. Therefore, when the drive element 2 is further moved forwardly by the tension of the spring 3, the driven element 4 is also moved forwardly as designated by the two-dotted broken lines in FIG. 4(B) while being rotated clockwise as the drive element 2 is moved forwardly to thereby engage with the guide groove 1f along the guide groove 1f. Consequently, the drive element 2 is moved forwardly at its stroke l from the door locked position. Thus, the door is opened with the locking device.

It should be understood from the foregoing description that since the push type temporary locking device constructed according to this invention can close and lock the door by attracting the drive element or catcher of magnet thereof to both close and open the door merely by pushing the door 6, needs no knob or the like on the surface of the door 6 but can still be applied for the temporary locking device for an inset door. It should also be appreciated that since the push type temporary locking device of this invention comprises the drive element 2 attached with the aforementioned catcher 2b and telescoped with the supporting box 1, the spring for urging the drive element 2 outwardly from the box 1, and the driven element 4 supported at the drive element 2 and retained at the element 2 at both retracted and extended positions of the element 2, the door can be accurately positioned at its locked position with respect to the door mounting frame 5 readily merely by disposing the door at its closed position in the state that the drive element 2 is depressed and retained. In addition, the driven element 4 is rotated cooperatively upon sliding operation of the drive element 2 when the door is opened or closed and is thus smoothly contacted with the rotating and engaging extension 1*h* exactly. Consequently, no erroneous operation occurs at the locking device to thereby conveniently open or close the door for the practical use.

It should also be understood that since only the magnet as the catcher 2*b* and the spring 3 may be made of metal and all other members may be made of plastic, the locking device of this invention is adapted for its mass production inexpensively.

What is claimed is:

1. A temporary locking device comprising:

a supporting box fixedly secured to a door mounting frame, a drive element attached with a catcher as a magnet at least at its front end and slidably inserted through the opening of said supporting box elastically by a spring disposed in said supporting box for projecting said drive element from said supporting box, a driven element rotatably supported at the internal end of said drive element and including at least two substantially V-shaped recesses symmetrically formed thereon, a guide groove formed on the inner wall surface of said supporting box for said driven element for slidably engaging said driven element, a rotating projection disposed at the internal end of said guide groove for eccentrically contacting said driven element at the depressing end of said drive element into said box to thereby rotate said driven element at its predetermined angle, and a rotating and engaging extension disposed at the internal end of said guide groove for eccentrically contacting said driven element to retain said driven element when said drive element is slightly moved forwardly from its depressing end and contacting said driven element to rotate in the direction for guiding itself into said guide groove when said drive element is moved forwardly after being again depressed into said box, both said rotating projecting and said rotating and engaging extension being faced oppositely at predetermined angle with respect to the sliding direction of said drive element.

2. The temporary locking device according to claim 1, wherein said guide groove, said roating projection and said rotating and engaging extension are formed by cutting the inner surface of the back cover of said supporting box.

3. The temporary locking device according to claim 1, wherein said driven element comprises at least two recesses symmetrically formed in flat drum shape substantially.

4. The temporary locking device according to claim 1, wherein said driven member comprises a plurality of or more than two of recesses radially formed in a flat gear wheel shape substantially.

* * * * *